United States Patent [19]

Holland

[11] Patent Number: 4,781,270

[45] Date of Patent: Nov. 1, 1988

[54] ELEVATOR DOOR ARRANGEMENT

[75] Inventor: Gordon A. Holland, Memphis, Tenn.

[73] Assignee: Delaware Capital Formation, Inc., Wilmington, Del.

[21] Appl. No.: 20,767

[22] Filed: Mar. 2, 1987

[51] Int. Cl.[4] ..... B66B 13/00

[52] U.S. Cl. ..... 187/56; 49/411; 49/120

[58] Field of Search ..... 187/56, 51, 52 R, 53; 49/410, 411, 116, 121, 119, 120; 104/173.1, 194; 384/24, 53

[56] References Cited

U.S. PATENT DOCUMENTS

| | | | |
|---|---|---|---|
| 1,450,729 | 4/1923 | Leeds | 49/410 |
| 3,426,480 | 2/1969 | Dzamba | 49/410 |
| 3,523,390 | 8/1970 | McAulay, Jr. | 187/56 |
| 4,573,286 | 3/1986 | Faurel et al. | 49/411 |
| 4,593,793 | 6/1986 | Salmon | 187/56 |

FOREIGN PATENT DOCUMENTS

| | | | |
|---|---|---|---|
| 1124209 | 2/1957 | Fed. Rep. of Germany | 187/56 |
| 455902 | 3/1950 | Italy | 49/120 |

*Primary Examiner*—Joseph J. Rolla
*Assistant Examiner*—Kenneth Noland
*Attorney, Agent, or Firm*—Brumbaugh, Graves, Donohue & Raymond

[57] ABSTRACT

An elevator door arrangement includes at least one door panel and means engaging upper and lower portions of the panel for guiding the upper and lower portions for parallel movement. The means for guiding the lower part of the panel includes a guide member coupled to the panel that projects through an elongated, narrow slot in the sill. In one embodiment, the sill has a guide channel below the slot, and the guide member has a guide element that slidingly engage the guide channel walls. In another embodiment, a cable relating device includes a section above the door and one below the door, connected for synchronous movement. The cable relating device is connected to the upper part of the panel and to the guide member for imparting parallel movement.

12 Claims, 7 Drawing Sheets

ELEVATOR DOOR ARRANGEMENT

BACKGROUND OF THE INVENTION

Elevator car doors include one or more panels that are supported by an overhead rail and open and close by way of a door operator. It is common practice to drive one of the door panels from a point near the top of the panels. Other door panels, if center-opening or two speed arrangements are used, are driven by a cable relating device mounted above the guide rollers. The direct driven panel also carries a clutch that engages one of the hatch door panels. As in the case of the car door panels, the other hatch door panel or panels are cable-related at a point above the opening.

A sill is disposed below the door panels, and is formed with grooves. Plastic gibs, attached to the bottom of the door and hatch panels, project into the sill grooves for guiding the panels.

A typical center-opening door arrangement is illustrated in FIGS. 1 and 1*a*, labeled "prior art". The door panels 10, 11 hang on guide rollers 14 supported by an overhead rail 12. A door operator pulley and linkage "D" are coupled to one of the panels, e.g. 11, at a point "P" near the top of the panel, to move the panel between open and closed positions, in the direction of arrows 13. The driven panel 11 is connected to the non-driven panel 10 through a cable-relating device 34, 36 mounted above the door opening. The door panels 10 and 11 are attached to oppositely moving sections of cable 36*a* and 36*b*, at 17 and 15, respectively, to move in opposite directions. A clutch membrr 30 on the driven car door panel 10 engages a clutch member 32 on the corresponding hatch door panel, and the hatch panels are cable related by a mechanism similar to the cable 36 and pulleys 34 used for the car doors.

FIGS. 1 and 1*a* illustrate a conventional plastic guide gib 18, that is mounted by a bracket 16 to the bottom of the door 10 and projects into a groove 22 formed in the door sill 20. A similar groove arrangement is normally provided for the hatch doors.

The presence of guide grooves in the sill is a tripping hazard to passengers entering and leaving the elevator. The grooves create maintenance problems, since they can catch foreign objects and jam the doors. They also collect dirt (and water) from washing and, from an aesthetic standpoint, are somewhat unsightly.

Another weakness of known door systems is the inability to drive the panels at their center of percussion. During acceleration and deceleration of the doors, a moment is produced about the center of gravity "C", causing a pendulum effect, if the net force applied to the panels 10 and 11 is not along the center of percussion "CP", i.e. parallel to the direction of door movement 13 and through the center of gravity "C". As a practical matter, it is not possible to avoid such a pendulum effect in conventional door systems.

When the door operator D is actuated, the drive linkage D applies force to door panel 11 at point P. Clutch 30 and cable attachment 15 impart forces on the door panel 11 in the opposite direction. In practice, it is not possible to position all of these force-transmission points along the center of percussion CP. Driving the door panel along the center of percussion makes the pendulum effect of the cable-relating device worse. Positioning the clutch mechanism 30, 32 along the center of percussion of the hatch panel makes the pendulum effect on the car door worse. In the case of the driven panel 10, the drive force is imparted overhead, at 17. It is therefore also not possible to drive the driven panel, in a cable related drive, along its center of percussion.

Up-thrust rollers are usually installed to counteract this tendency. But, up-thrust rollers do not completely eliminate the problem because, for quietness, there must be running clearance between the up-thrust rollers and the track.

SUMMARY OF THE INVENTION

The present invention is an improved elevator door system. According to one aspect of the invention, elevator doors have an arrangement for guiding the lower portion of the elevator doors, which reduces or eliminates the problems of tripping and jamming due to the build-up of foreign objects. According to another aspect of the invention, elevator doors include a drive system which effectively eliminates the pendulum effect of conventional door drives.

More specifically, an elevator system has a door with an overhead guide member for supporting the weight of the door, a door drive, and a lower guide member that projects through an elongated, relatively narrow slot in the upper surface of the sill. Means are provided below the sill upper surface engaging the guide member for guiding the same for movement parallel with the upper end of the panel. These means may be coupled to an overhead cable so that the door is driven both at its upper and lower ends.

In one form of the invention, the sill is provided with a pair of laterally opposed, preferably vertical guide surfaces, spaced apart wider than the slot, that define a guide channel disposed below the slot. The guide member includes a guide element disposed below the slot which slidingly engages the guide surfaces.

The guide channel may be located directly below the slot or may be displaced from the slot. In the latter case, the guide channel is preferably open along its bottom, and the guide member projects into the guide channel from below.

Preferably, the sill is mounted on a sill support and the bottom of the sill, below the guide channel, is open. The sill support is provided with a corresponding opening positioned under the slot and guide channel for passing dirt, water, debris and the like that has entered through the slot out away from the slot and guide surfaces. The use of a narrow slot protects the guide surfaces from dirt and foreign objects, and thus lessens the likelihood of clogging or jamming. In embodiments where the guide channel bottom is open and communicates with an opening in the sill support, any dirt or water that does enter escapes. In embodiments where the guide channel is displaced from the slot, the guide surfaces are also protected from dirt.

Preferably, an elevator system according to the present invention having more than one panel includes an improved drive system formed of first means for driving each door panel at an upper portion thereof, and second means, connected to the first means, for synchronously driving each door panel at a lower portion thereof.

In one arrangement, the elevator includes a cable relating mechanism with a cable extending, in a continuous path, above the elevator door, down one side of the car, and below the elevator doors. Each door panel is connected both at the top and bottom to a cable portion for movement therewith. The lower cable portion is disposed below the door sill, preferably in the interior of the sill support, and the lower guide member extends through an elongated slot formed in the sill, and a corresponding opening in the upper wall of the sill support, to enaage the lower cable portion.

In an alternative embodiment, the cable relating mechanism includes a first elongate member, such as a belt or cable, disposed above the door panels, and a second elongate member disposed below the door panels. Means, such as a common drive shaft, extend between the upper and lower elongate members for driving each in unison with the other. The door panels are connected to the upper and lower members fo synchronous movement therewith.

For multiple speed panels, the cable relating mechanism can include a pair of elongate members mounted on common shafts on pulleys of different size. An arrangement is provided for both the upper and lower portions of the door, and connected by a common shaft.

In the present drive arrangement, it is preferred to drive the hatch doors with clutch elements disposed between each car and corresponding hatch door. The clutch elements are positioned at the center of percussion of the hatch door panels. Alternatively, a pair of vertically spaced clutches are employed so that, in either case, there is no moment imparted to the hatch doors through the clutch mechanisms.

For a better understanding of the invention, reference is made to the following Detailed Description of Preferred Embodiments, taken in conjunction with the drawings accompanying the application.

DETAILED DESCRIPTION OF PREFERRED EMBODIMENTS

Figure 2:
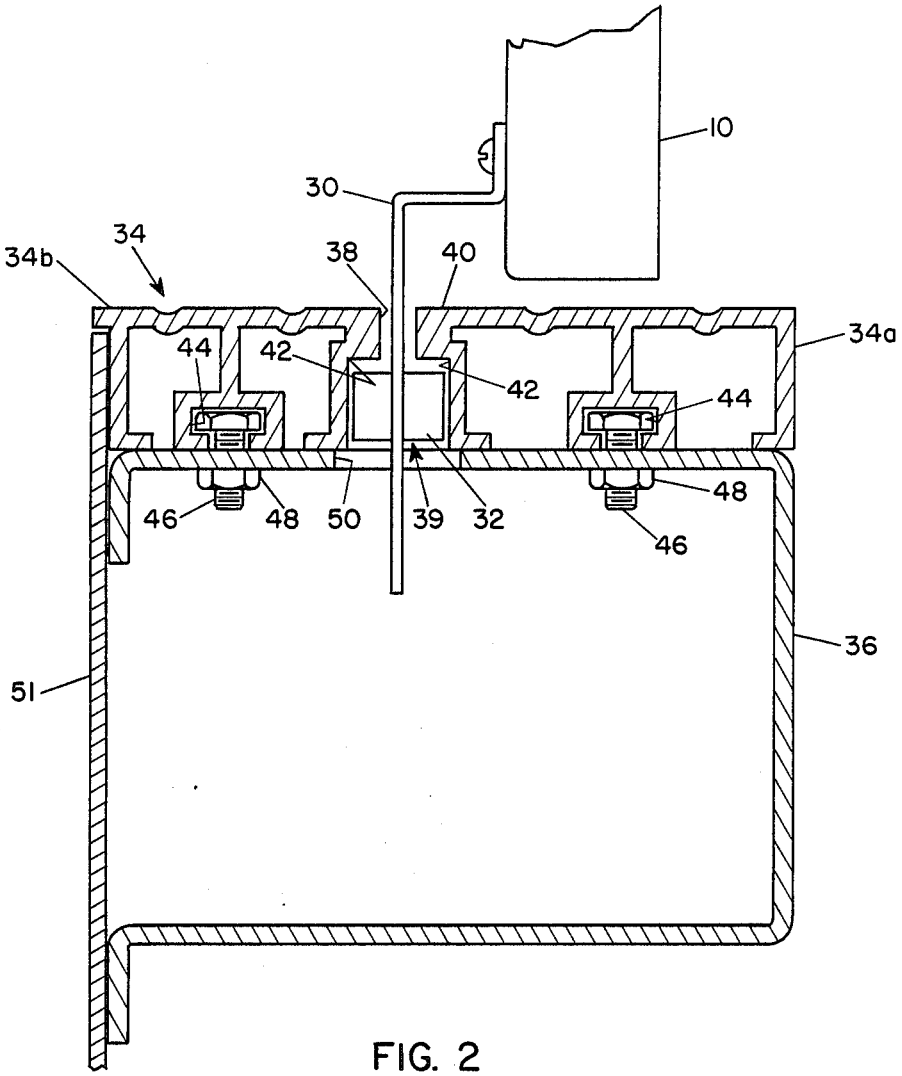
FIG. 2 is a side view, partially in section, of one embodiment of an elevator door arrangement in accordance with the invention.

FIG. 2 illustrates in cross-section a sill 34 composed of two sill portions 34*a* and 34*b*. The sill 34 is mounted on a channel-shaped sill support member 36, by way of a downwardly open key slot 44 formed in each sill portion that receives the head of a bolt 46. The bolts 46 project through the upper wall of the sill support, and are tightened down by nuts 48. A toe guard 51 is attached to the front of the sill and sill support arrangement.

Figure 3:
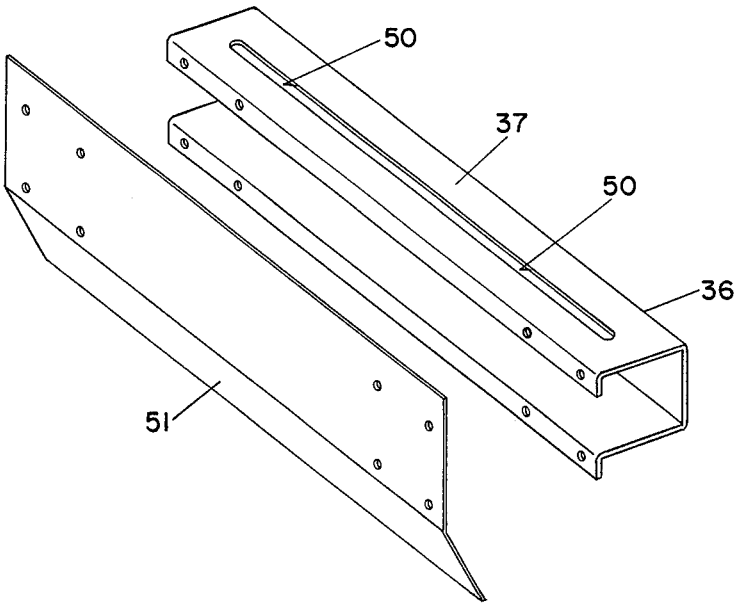
FIG. 3 is a profile view of the sill support shown in FIG. 2.

The sill portions 34*a*, 34*b* include a pair of facing vertical portions defining a narrow elongated slot 38 through the upper surface 40. A pair of opposed, longitudinally extending guide walls 42, spaced apart a distance wider than the slot 38, define a guide channel 39 disposed below the slot 38. The guide channel 39 is open at the bottom, and communicates with an elongated opening 50 in the sill support upper wall 37 (FIG. 3).

Figure 1:
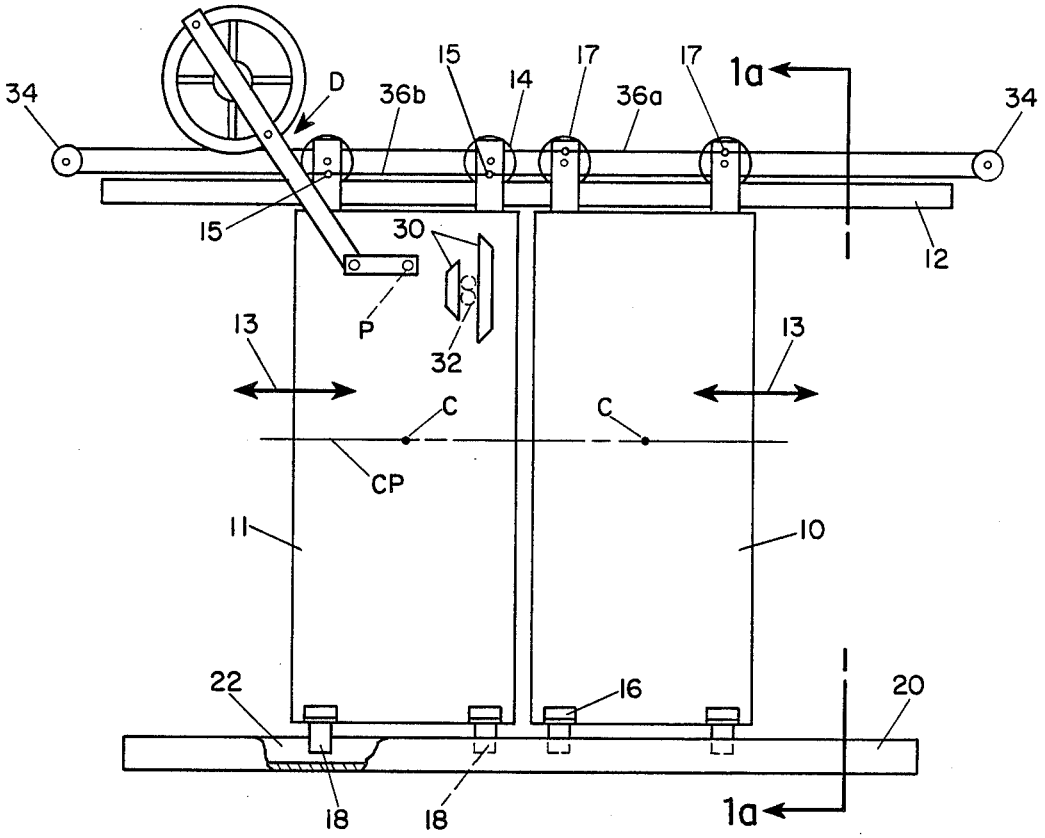
FIG. 1 (PRIOR ART)
FIG. 1 is a front, schematic view of a typical prior art elevator car door arrangement.
Figure 1A:
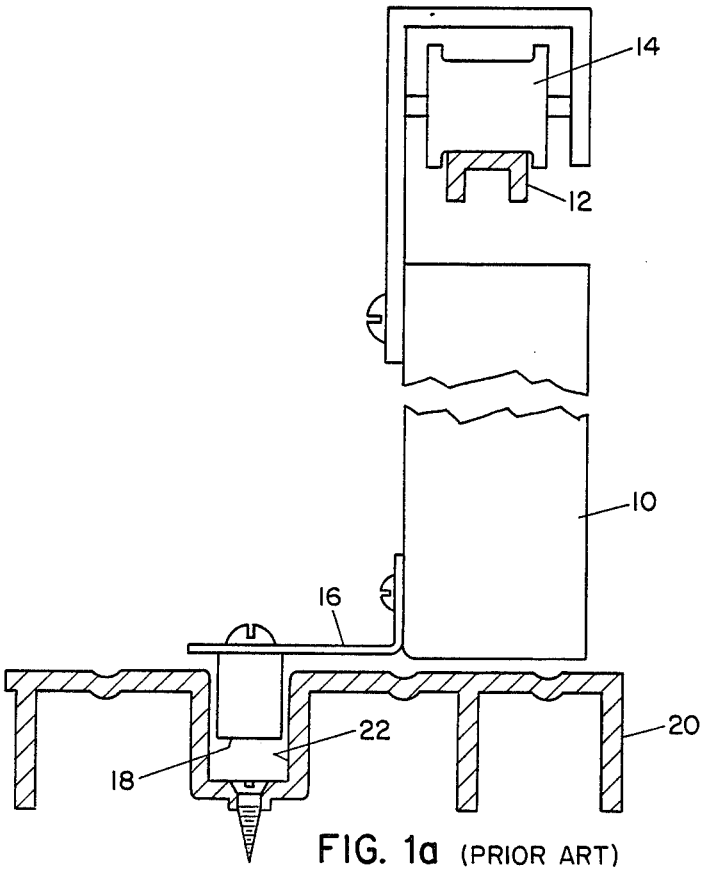
FIG. 1a (PRIOR ART)
FIG. 1*a* is a side, schematic view, on a larger scale, of the elevator car door arrangement shown in FIG. 1, taken through lines 1*a*—1*a;*

An elevator door panel 10, which may be supported and driven in the same manner as panel 10 or 11 in FIG. 1, has a guide member 30 attached to its lower end. The guide member 30 projects downwardly through the slot 38, and includes guide element 32 disposed in the guide channel 39 that slidingly engages the opposed guide walls 42. Preferably, each door panel 10 has a pair of guide members 30 spaced along the door bottom. If desired, spacers may be inserted in sections of the slot 38 outside the path of movement of the guide members 30.

Figure 4:
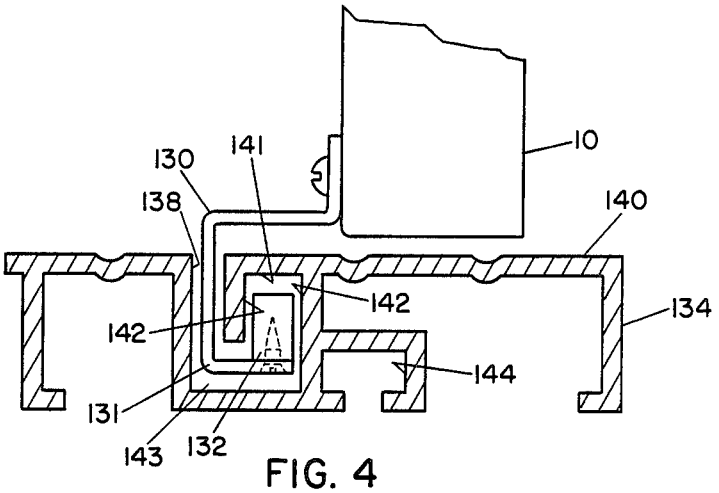
FIG. 4 is a side view, partially in section, of an alternative embodiment of a sill member and guide means for the lower portion of an elevator door.

FIG. 4 shows a modified sill member 134 that may be formed as a single extrusion. The sill 134 has a narrow slot 138 through its upper surface 140 that communicates with a guide channel 141, formed by opposed vertical guide surfaces 142. Channel 141 is disposed below upper surface 140 and slot 138 but is laterally displaced relative to the slot 138. The bottom of the guide channel 141 is open, and communicates with the slot 138 through a connecting passage 143.

The guide member 130, attached to the bottom of the door 10, extends through the slot 138 and passage 143 and includes a guide element 132 that extends up into guide channel 141 in sliding engagement with the opposed vertical guide surfaces 142. A downwardly open key slot 144 is provided for mounting the sill to a sill support member in a manner similar to FIG. 2.

Figure 5:
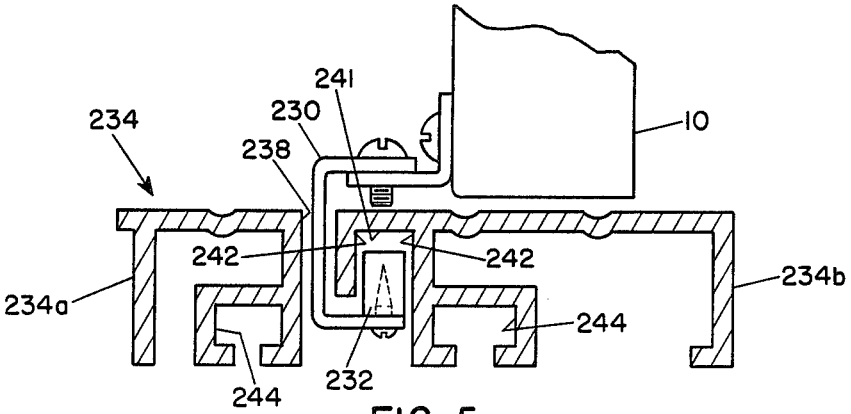
FIG. 5 is a side view, partially in section, of another embodiment of a sill and guide means for the lower portion of an elevator door.

FIG. 5 illustrates another embodiment of a sill 234. The sill 234 is formed of two extrusion members 234*a* and 234*b*, and the guide channel 241, which contains vertical guide surfaces 242, is laterally displaced relative to the slot 238 in a manner similar to FIG. 4. The sill 234 is open beneath the slot and guide channel, and a downwardly open key slot 244 is provided for each sill portion 234*a*, 234*b* for mounting the sill on a sill-support, preferably of the type shown in FIG. 3 having openings in its upper wall in registry with the slot 238.

A guide member 230, attached to the door 10, projects downwardly through the narrow slot 238, extends to the open bottom of the guide channel 241, and includes a guide element 232 that extends up into the guide channel 241 in sliding engagement with guide surfaces 242.

Figure 6:
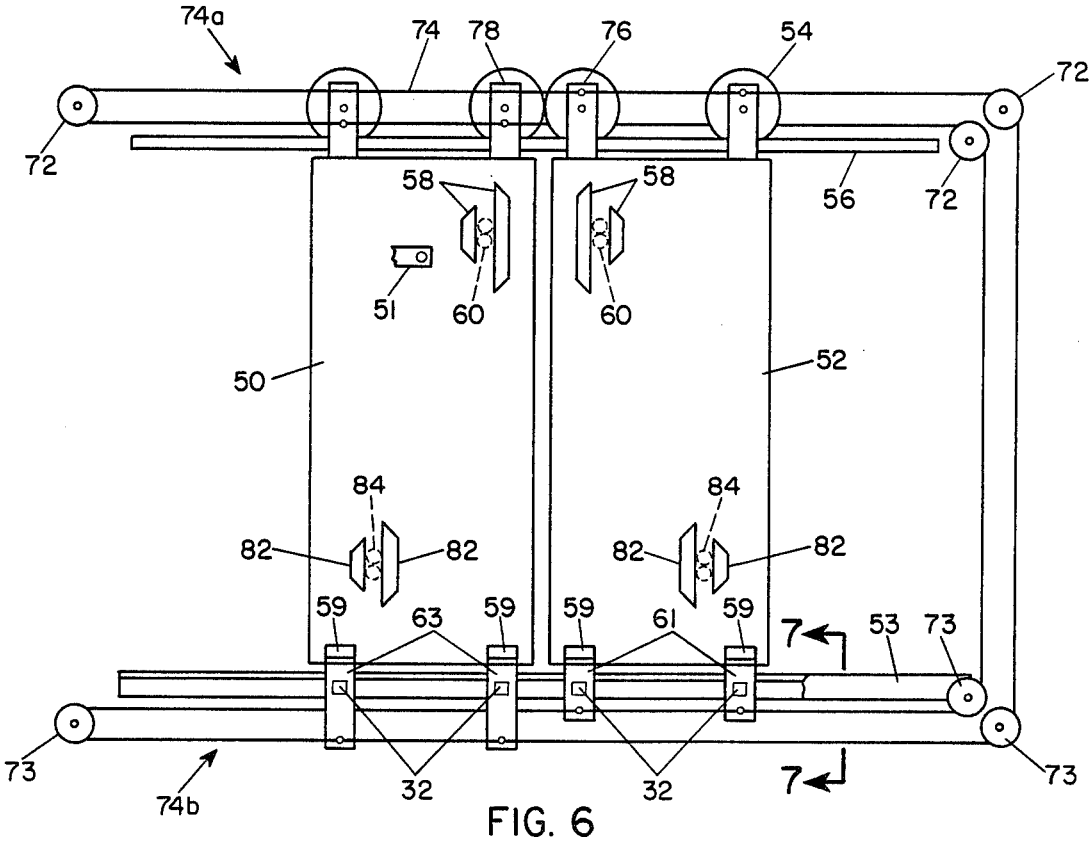
FIG. 6 is a front, schematic view of a centeropening elevator car door arrangement.
Figure 7:
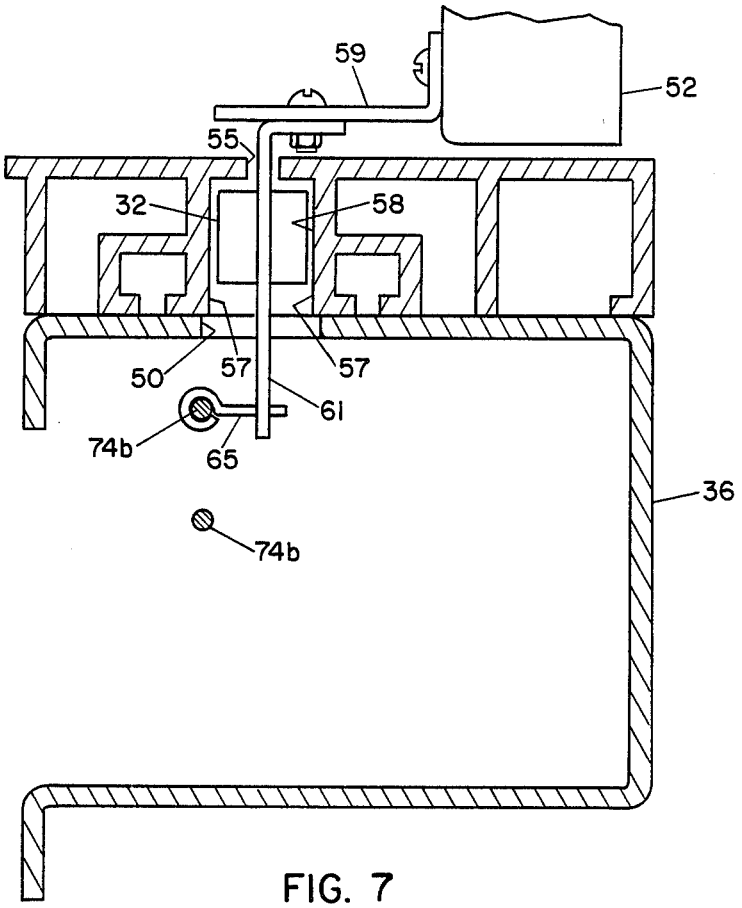
FIG. 7 is a cross-sectional view, taken through lines 7—7, of FIG. 4.

FIGS. 6 and 7 illustrate one embodiment of a center opening car door arrangement including a sill and guide member of the type shown in FIG. 2, and further including a novel means for driving the door panels.

The panels 50, 52 are hung on rollers 54 by brackets 76, 78, and an overhead rail 56 in turn supports and guides the rollers 54. One of the panels, e.g. 50, is driven by a drive linkage 51 in a conventional manner. The elevator car includes a sill 53 which, as shown in cross-section in FIG. 7, is provided with an elongated, narrow slot 55. Below the narrow slot 55, a pair of oppositely spaced walls 57 define a guide channel 58. The sill 53 is mounted on sill support member 36, which includes an opening 50 disposed below the open bottom of the slot 55 and guide channel 58.

A pair of brackets 59 mount guide members 61 and 63 to the bottom of each door panel 50, 52. The guide members 61, 63 project down through the slot 55, guide channel 58, and into the channel interior of the sill support member 36. Each guide member 61 includes a plastic guide element 32 disposed below the slot in sliding contact with the guide walls 57.

A cable relating device includes a cable 74, which is guided by a set of pulleys 72 spaced above the door, and a set of pulleys 73 spaced below the doors, so as to extend in a continuous path above the door opening, down the side of the doors, below the door opening, and then back. The cable 74 thus has a first cable section **74*a* above the doors, providing reciprocal cable movement parallel to the direction of door movement, a second cable section 74*b* below the doors, providing reciprocal cable movement parallel to the direction of door movement, and means 74*c*** connecting the two cable sections for synchronous movement.

As shown in FIG. 7, the lower section of cable **74*b* may be disposed in the channel interior of the sill support 36. Brackets 76 and 78 are connected to oppositely moving sections of cable above the door, and guide elements 61 and 63 are attached to oppositely moving sections of cable below the door, for example by clamps 65**.

The door drive arm 51 moves panel 50 toward the left or right to open or close the doors, respectively. Force applied to the panel 50 by arm 51 is transmitted to the cable 74 both at the top and bottom of the panel 50, i.e. through brackets 78 and through guide members 61. The cable 74, in turn, drives the other panel 52 at both its upper and lower ends. Thus, the cable relating mechanism tends to eliminate pendulum effect in two ways: first, by acting on the panels on opposite sides of the center of gravity, and second, by guiding the top and bottom of each panel for parallel, synchronous movement, i.e. constraining movement other than parallel to the direction of proper door movement.

Clutch elements 58 and 82 are provided on each car door panel 50, 52, and engage corresponding hatch door clutch elements 60, 84. The clutch elements 58, 68, 82, 84, per se, are conventional and thus shown only schematically. The clutches 58, 60 and 82, 84 are provided in pairs vertically spaced relative to one another so as to avoid imparting any pendulum effect in the hatchway doors. Alternatively, as described further relative to FIG. 12, a single pair of clutch elements may be located at the center of percussion of the hatch doors.

Figure 8:
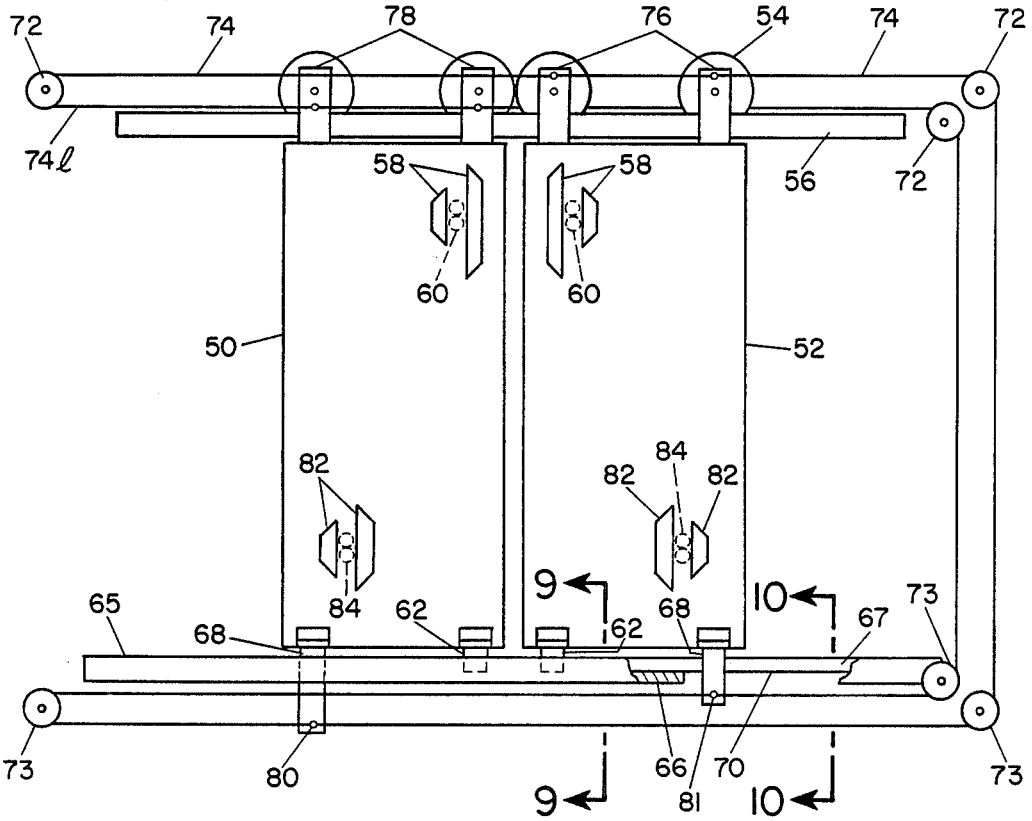
FIG. 8 is a front, schematic view of another center-opening elevator car door arrangement.
Figure 9:
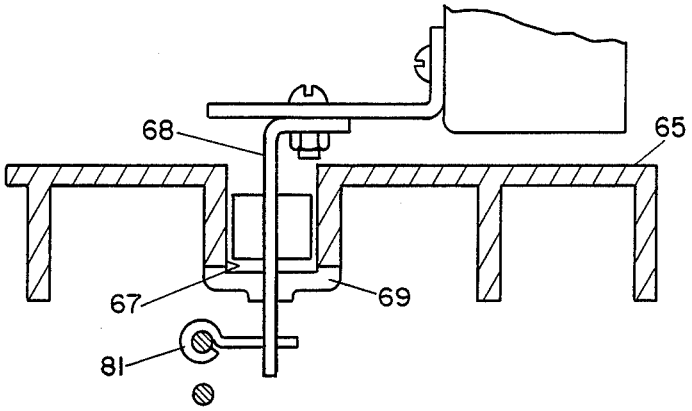
FIG. 9 is a cross-sectional view, taken through lines 9—9 of FIG. 8.
Figure 10:
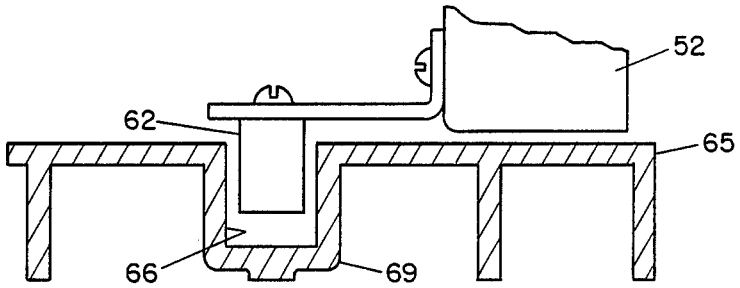
FIG. 10 is a side, cross-sectional view, taken through lines 10—10 of FIG. 8.

In the embodiment of FIGS. 8–10, the sill member 65 has a conventional guide groove 66 along its length. The lower portions of the panels 50, 52 support a pair of gibs 62 which are received in the guide groove 64. The guide groove bottom wall 69 is removed along portions of the sill, and a guide member 68, attached to the panel bottoms, projects through the groove to below the level of the sill. There, the guide members 68 are connected to oppositely moving sections of cable, in a cable relating device similar to FIGS. 6–7, by clamps 80, 81. The section of guide groove bottom wall removed corresponds to the movement of guide elements 68 between "door open" and "door closed" positions.

Preferably, the sill 64 is mounted on a sill support 36 (FIG. 3) and the lower section of cable 74 is disposed in the sill support interior in a manner already shown.

Figure 11A:
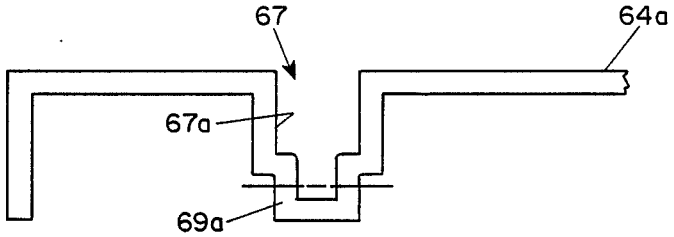
FIGS. 11*a*, 11*b*, and 11*c* are cross-sectional views of three exemplary sills that may be used in the embodiment of FIGS. 8–10.
Figure 11B:
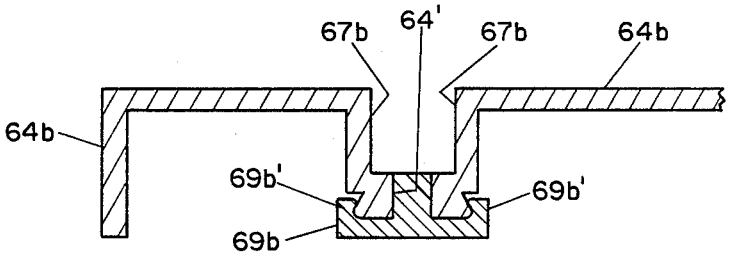
Figure 11C:
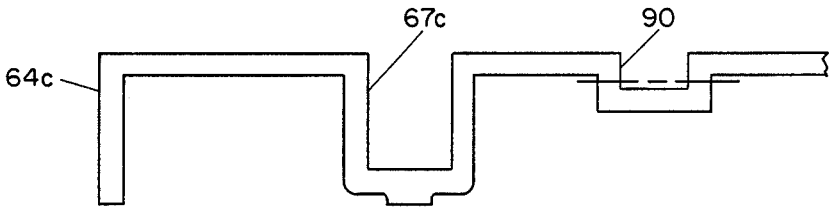

FIGS. **11*a*–11*c* illustrate three embodiments of a sill for use in the arrangement of FIGS. 8–10. In FIG. 11*a*, the sill is extruded to form a guide groove 67 and a bottom 69*a* with a more narrow width. The bottom 69*a* is milled off or otherwise removed along the portions of the sill 64*a* corresponding to the path of guide members 68**.

In FIG. **11*b*, the sill is formed by a pair of extrusions 64*b* and a bottom extrusion 69*b*. Each extrusion 64*b* includes a vertical wall 67*b*, and member 69*b* includes positive locking flanges 69*b*' that engage the elements 64*b* so as to space the walls 67*b* to form a guide groove. The extrusion 69*b* is used where a slot is not required for the guide member 68**.

FIG. **11*c* shows a sill 64*c*, which includes a gib groove 67*c* and a second groove 90 spaced from the gib groove 67*c*. Portions of the groove 90 are milled off or otherwise removed so as to form a slot in the areas required for movement of the downwardly projecting guide member 68**.

Figure 12:
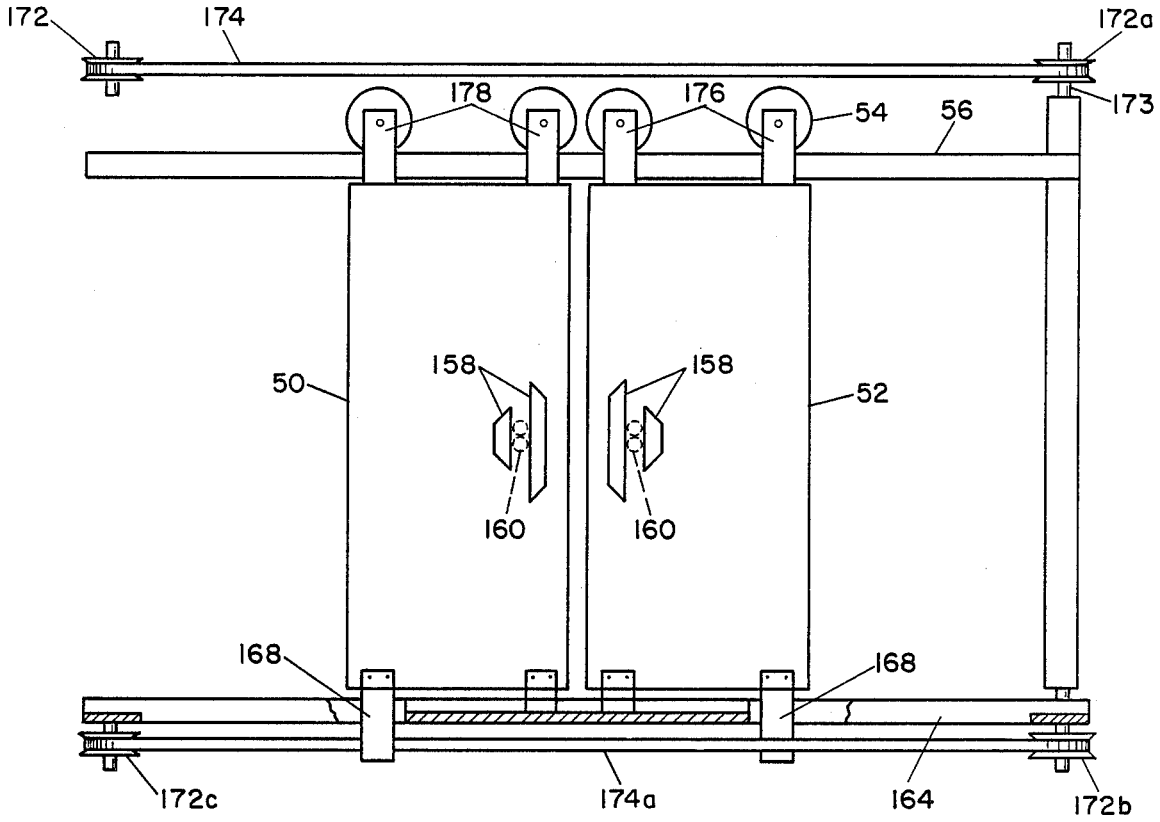
FIG. 12 is a front, schematic view of another center opening car door arrangement.

In the FIG. 12 door drive arrangement, a pair of panels 50, 52 are suspended from a track 56 by rollers 54 mounted on bracket members 176, 178. The drive means includes an upper belt drive made up of a belt 174 suspended between a pair of pulleys **172, 172*a*, and a lower belt drive made up of belt 174*a* suspended between pulleys 172*b* and 172*c*. Belt 174*a* is preferably disposed in the interior of a sill support member (not shown). One of the upper pulleys 172*a* is connected, by way of an elongated shaft 173, to one of the lower pulleys 172*b*, so that the upper and lower belts 174, 174*a*** move synchronously.

The panels 50, 52 include guide members 168 that extend through slots in the sill member 164. One of the brackets 178 and the guide member 168 of panel 50 are attached to the upper and lower belts **174, 174*a*, respectively. The other guide member 168 (on panel 52) and bracket 176 are attached to sections of the belts 174, 174*a* moving oppositely to panel 50. Each panel 50, 52 is provided with a clutch element 158 that engages a respective hatch door clutch element 160**.

The clutch elements 158, 160 are positioned at the center of percussion of the hatch door panels. In view of the fact that the cable relating device engages each of the panels 50, 52 at both their upper and lower ends, clutch elements engaging the hatch panels will not produce a pendulum effect on the doors. This means that the hatch panel corresponding to the driven door may be coupled by a clutch rather than a hatch panel cable relating device, as in conventional designs, without creating a pendulum effect on the driven car panel.

Figure 13A:
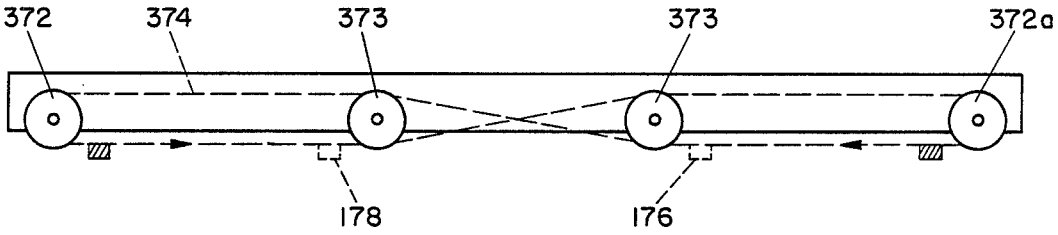
FIG. 13*a* and 13*b* are top and front views of the upper part of an alternative elevator door drive arrangement.
Figure 13B:
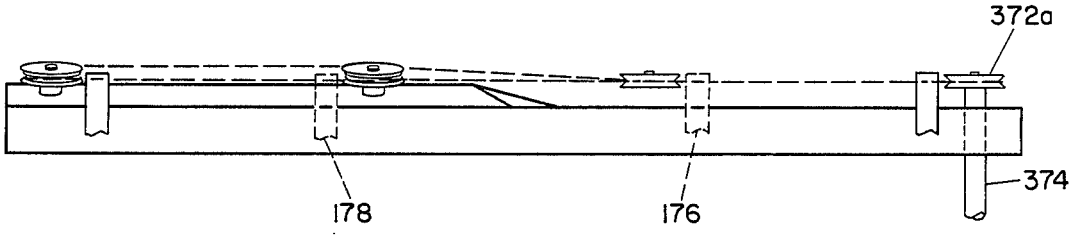

FIGS. **13*a*–13*b* disclose a modified form of the pulley arrangement for driving center opening door panels. A cable 374 extends between guide pulleys 372 and 372*a*, but is twisted to cross over at the center of the elevator car, between idler pulleys 373. Pulley 372*a* is mounted on a guide shaft 374 which is connected to a corresponding pulley arrangement below the car. The FIGS. 13***a–b* embodiment is similar to that shown in FIG. 12, except that the brackets 176, 178 are attached to the forward portion of the cable on both sides.

Figure 14A:
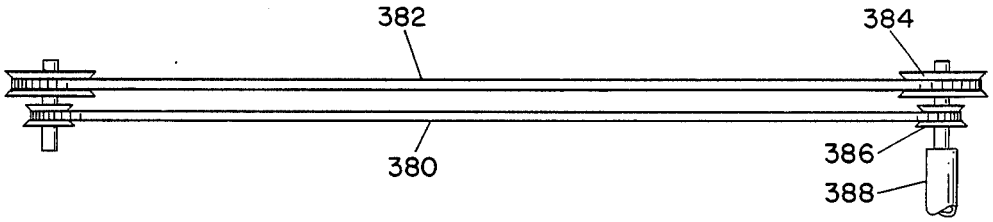
FIG. 14*a* and 14*b* are side and top views of the upper part of an elevator door drive for a two speed panel arrangement.
Figure 14B:
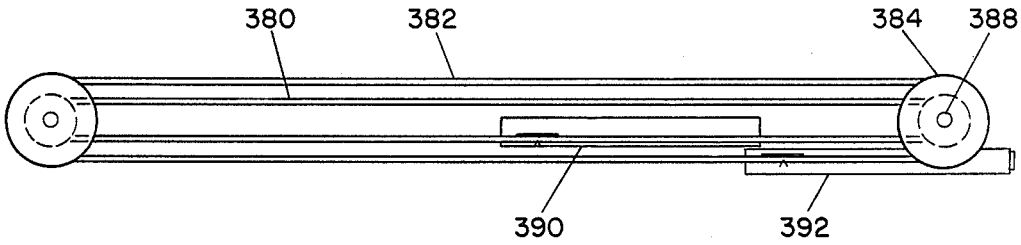

FIGS. 14*a* and 14*b* show a drive for a two speed door arrangement. A pair of timer belts or chains 380, 382 are mounted on commonly axled pulleys 384, 386 for synchronous rotation at different speeds. A slow speed door panel 390 is attached to belt 380, and a fast speed door panel 392 is attached to belt 382. Shaft 388 extends to a lower portion of the elevator car, where a similar dual speed pulley arrangement is provided. A guide member on the bottom of each panel 390, 392 is then connected to the appropriate belt below the doors. In this manner, the upper and lower belts are driven synchronously for driving the upper and lower portions of the door.

Figure 15:
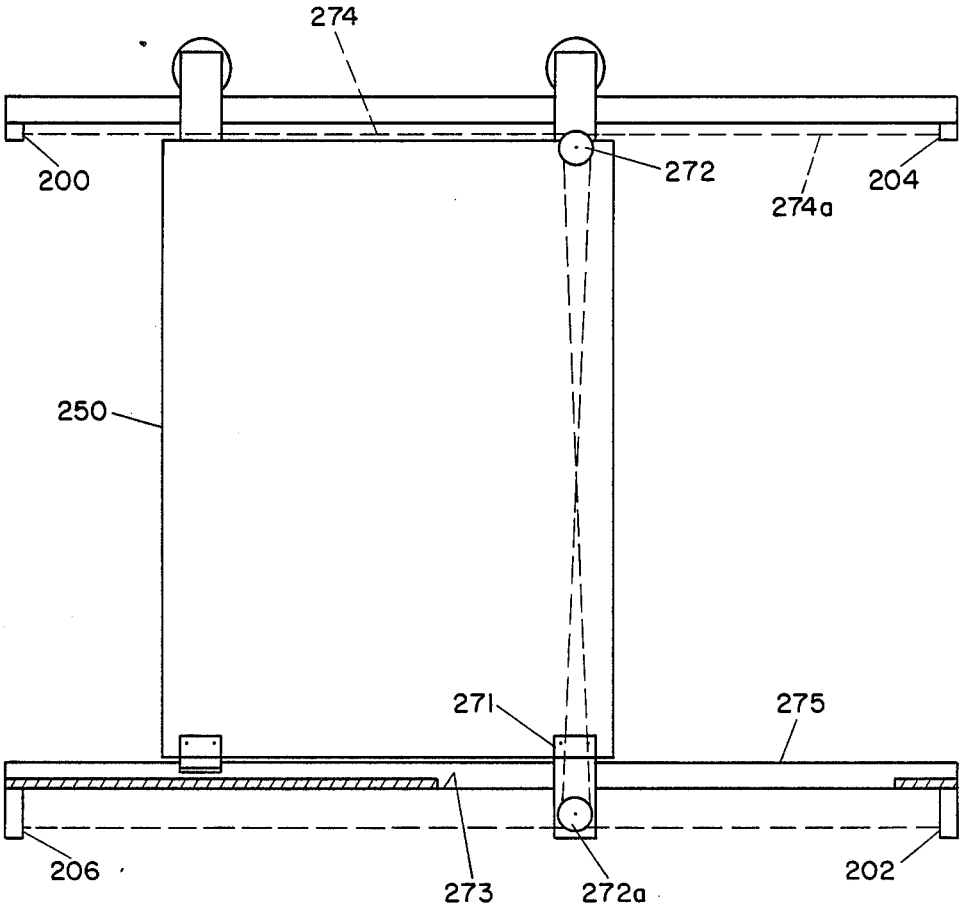
FIG. 15 is a front, schematic view of a door drive for a single panel.

FIG. 15 shows a drive for a single panel door. The door panel 250 includes a lower guide member 271 that projects through an opening 273 in the bottom of sill 275. Sill 275 as shown is similar in configuration to the sill in FIG. 8. The panel 250 includes a first guide pulley 272 disposed in the upper area of the door, and a second guide pulley 272*a* mounted on lower guide member 271 below the sill opening 273. A first cable 274 is connected to diagonally opposite corners 200, 202 of the door frame and extends from corner 200 to pulley 272, vertically downward to the lower pulley 272*a*, and thereafter below the door sill 275 to corner 202. A complementary cable 274*a* may be provided, extending between the other pair of diagonally opposed corners, 204, 206 about the pulleys 272, 272*a*.

The foregoing represents preferred embodiments of the invention. Variations and modifications of the embodiments shown and described will be apparent to persons skilled in the art, without departing from the inventive concepts disclosed herein. All such modifications and variations are intended to be within the scope of the invention, as defined in the following claims.

I claim:

1. An elevator door arrangement having at least one door panel; door drive means for moving said panel along an axis between open and closed positions; first guide means coupled to an upper portion of said panel for guiding said panel for movement parallel to said axis; a sill, disposed below said panel, having an upper surface with an elongated slot therethrough, said slot extending parallel to said axis; a guide member coupled to a lower portion of said panel and projecting down through said slot; and second guide means disposed below said slot and engaging said guide member for movement parallel to said axis;

wherein the means for guiding said guide member comprises a pair of opposed guide surfaces defining a guide channel disposed below said slot, said guide surfaces being spaced apart a distance wider than said slot, and wherein said guide member includes a guide element disposed below said slot and between, and in sliding engagement with, the guide surfaces.

2. An elevator door arrangement as defined in claim 1, wherein the guide channel has an open bottom to permit dirt, water and foreign objects that enter the guide channel through the slot to pass through the guide channel rather than accoumulate adjacent the guide surfaces.

3. An elevator door arrangement as defined in claim 2, comprising a sill support means having a support surface, wherein said sill is mounted on said support surface, and wherein said support surface has an elongate opening communicating with the open bottom of the guide channel for passage of dirt, water and foreign objects.

4. An elevator door arrangement as defined in claim 2, wherein said guide channel is laterally displaced relative to said slot, wherein the sill includes a guide passage communicating between the slot and open bottom of the guide channel, and wherein said guide member extends through said passage and up into said guide channel from below.

5. An elevator door arrangement as defined in claim 1, comprising a sill support means having a support surface, wherein said sill is open vertically beneath the slot and is mounted on said sill support surface, and wherein said support surface includes an elongate opening communicating with the slot for passing dirt and other contaminants.

6. An elevator door arrangement as defined in claim 1, comprising a sill support means, wherein said sill comprises at least two sill portions, each having an upper vertical edge surface, and means for mounting said sill portions on said sill support means for spacing said edge surfaces from one another to define said slot.

7. An elevator door arrangement having at least one door panel; door drive means for moving said panel along an axis between open and closed positions; first guide means coupled to an upper portion of said panel for guiding said panel for movement parallel to said axis; a sill, disposed below said panel, having an upper surface with an elongated slot therethrough, said slot extending parallel to said axis; a guide member coupled to a lower portion of said panel and projecting down through said slot; and second guide means disposed below said slot and engaging said guide member for guiding said guide member for movement parallel to said axis;

wherein the means for guiding the guide member comprises a cable relating device including a cable engaging the guide member, and means coupled to the upper portion of the panel for displacing the cable, and thereby the guide member and lower portion of the door panel, responsive to movement of the upper portion of the door panel.

8. An elevator door arrangement having at least one door panel; door drive means for moving said panel along an axis between open and closed positions; first guide means coupled to an upper portion of said panel for guiding said panel for movement parallel to said axis; a sill, disposed below said panel, having an upper surface with an elongated slot therethrough, said slot extending parallel to said axis; a guide member coupled to a lower portion of said panel and projecting down through said slot, and second guide means disposed below said slot and engaging said guide member for guiding said guide member for movement parallel to said axis, and further comprising a second door panel having a guide member projecting through said slot, and comprising first drive means disposed above the door panels, second drive means disposed below the panels, means coupled between said first and second drive means for actuating said means in unison, means for coupling said first drive means to an upper portion of each door panel, and means for coupling said second drive means to said guide members.

9. An elevator door arrangement as defined in claim 8, wherein said first drive means includes a first elongate member extending above the door, wherein said second drive means includes a second elongate member extending below the door, each member including sections moving in opposite directions parallel to said axis, and wherein the door panels, and their respective guide members, are coupled to oppositely moving sections of the elongate member.

10. An elevator door arrangement as defined in claim 9, wherein the elongate members are sections of a cable.

11. An elevator door arrangement as defined in claim 10, wherein the means coupled between the first and second elongate members comprise another section of cable co-extensive with the elongate members to form one continuous cable, and pulley means for guiding the cable above the door opening, down the side of the car, and below the door opening.

12. An elevator door arrangement as defined in claim 9, wherein the means for moving the elongate members in unison comprises a shaft disposed between said first and second elongate member.

* * * * *